US010961680B2

(12) United States Patent
Olsen et al.

(10) Patent No.: US 10,961,680 B2
(45) Date of Patent: Mar. 30, 2021

(54) INSTALLATION OF EMBEDDED SUBSEA FOUNDATIONS

(71) Applicant: Subsea 7 Norway AS, Stavanger (NO)

(72) Inventors: Christian Linde Olsen, Stavanger (NO); Christian Wathne, Sandnes (NO)

(73) Assignee: Subsea 7 Norway AS, Stavanger (NO)

( * ) Notice: Subject to any disclaimer, the term of this patent is extended or adjusted under 35 U.S.C. 154(b) by 0 days.

(21) Appl. No.: 16/084,935

(22) PCT Filed: Mar. 9, 2017

(86) PCT No.: PCT/EP2017/055593
§ 371 (c)(1),
(2) Date: Sep. 13, 2018

(87) PCT Pub. No.: WO2017/157766
PCT Pub. Date: Sep. 21, 2017

(65) Prior Publication Data

US 2019/0078287 A1 Mar. 14, 2019

(30) Foreign Application Priority Data

Mar. 14, 2016 (GB) ..... 1604310

(51) Int. Cl.
*E02D 27/52* (2006.01)
*E02D 27/42* (2006.01)
(Continued)

(52) U.S. Cl.
CPC ..... *E02D 27/525* (2013.01); *E02D 7/20* (2013.01); *E02D 27/42* (2013.01); *E02D 5/285* (2013.01); *E02D 5/60* (2013.01)

(58) Field of Classification Search
CPC ..... B63B 21/27; B63B 2021/265
(Continued)

(56) References Cited

U.S. PATENT DOCUMENTS 3,341,357 A 9/1967 Feild
5,992,060 A 11/1999 Treu et al.
(Continued)

FOREIGN PATENT DOCUMENTS

DE 195 33 014 A1 3/1997
GB 1 451 537 10/1976
(Continued)

OTHER PUBLICATIONS

API Specification 13A, "Specification for Drilling-Fluid Materials," Sections 9 and 10, pp. 28-32 (1993).
(Continued)

*Primary Examiner* — Sean D Andrish
(74) *Attorney, Agent, or Firm* — Levy & Grandinetti

(57) ABSTRACT

A bearing surface of a subsea foundation has a low-resistance coating such as an aerogel, an aero-clay or a polymeric film. When the foundation is installed, the bearing surface is embedded in the seabed soil using the low-resistance coating to reduce resistance movement of the bearing surface relative to the seabed soil. The coating may then dissolve or fragment away from the bearing surface or transform into a higher-resistance state while remaining on the bearing surface. These mechanisms degrade a resistance-reducing property of the coating to increase resistance to movement of the embedded bearing surface relative to the seabed soil. Suction may be applied to the foundation before or after the resistance-reducing property of the coating has substantially degraded.

25 Claims, 17 Drawing Sheets

Figure 1:
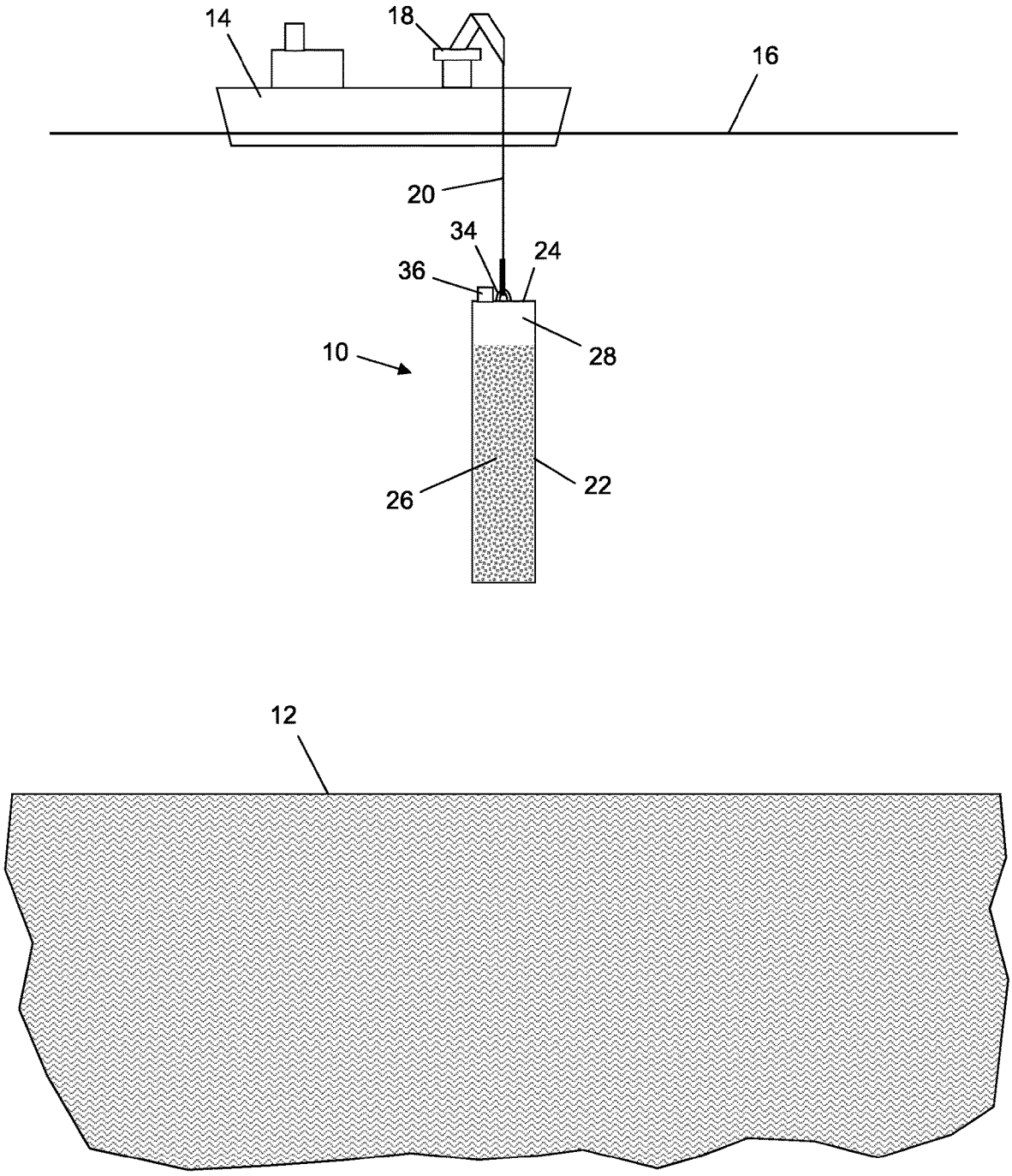

(51) Int. Cl.
*E02D 7/20* (2006.01)
*E02D 5/28* (2006.01)
*E02D 5/60* (2006.01)

(58) Field of Classification Search
USPC ..... 405/231, 232
See application file for complete search history.

(56) References Cited

U.S. PATENT DOCUMENTS

| | | | | |
|---|---|---|---|---|
| 8,268,391 | B2 | 9/2012 | Ioelovich et al. | |
| 2015/0275461 | A1* | 10/2015 | Kwon | E02D 27/52 405/224 |

FOREIGN PATENT DOCUMENTS

| | | | |
|---|---|---|---|
| JP | 2003-328359 | | 11/2003 |
| SU | 949067 | * | 8/1982 |
| SU | 949067 | A1 | 8/1982 |
| WO | WO 2015043856 | A1 | 4/2015 |

OTHER PUBLICATIONS

DNV-RP-E303, "Geotechnical Design and Installation of Suction Anchors in Clay" (2005).
NSF/ANSI 60, "Drinking Water Treatment Chemicals—Health Effects" (2016).

* cited by examiner

INSTALLATION OF EMBEDDED SUBSEA FOUNDATIONS

This invention relates to simplifying and quickening the installation of subsea foundations that are designed to be embedded into the seabed. Such foundations are exemplified in this specification by suction piles.

The invention also aims to improve the resistance to movement of embedded subsea foundations once they are installed. In principle, this may allow the size and hence the cost of such foundations to be reduced without sacrificing their efficacy.

Suction piles are commonly used in the subsea oil and gas industry for anchoring large offshore installations to the seabed in deep water. To do so, they are designed to engage soft seabed soil that typically comprises marine sediments or soft clays.

Suction piles engage the seabed soil by friction and/or by cohesion attributed to van der Waal forces. The engagement mechanism depends upon the composition of the soil. Engagement of a suction pile with a sandy seabed is based more on friction whereas engagement with a clay seabed is based more on cohesion.

Suction piles are also known in the art as suction anchors, suction cans, suction caissons or suction buckets. The design of such foundations may be determined with reference to standards such as DNV-RP-E303, entitled *Geotechnical Design and Installation of Suction Anchors in Clay.*

A suction pile is usually fabricated from steel and typically comprises a deep cylindrical skirt defining an open-bottomed hollow straight tube. The skirt engages the seabed soil by friction or cohesion upon being embedded axially into the soil.

The top of the skirt is closed by a steel top plate. This defines a suction chamber between the top plate, the skirt and the seabed soil trapped within the embedded skirt. Underpressure in the suction chamber also promotes engagement of the suction pile with the seabed.

The top plate may comprise openable hatches or may be attached to the skirt only after the skirt has been lowered to the seabed. This reduces drag and improves stability while lowering the suction pile, or the skirt, through the water.

When a suction pile is landed on the seabed in an upright orientation, the skirt embeds partially into the seabed soil under the self-weight and momentum of the pile. The soil within the embedded skirt closes the bottom of the pile to create the suction chamber. When seawater is subsequently pumped out of the suction chamber as disclosed in GB 1451537, the resulting underpressure in the chamber draws the top plate toward the seabed. This causes the skirt to sink further into the soil as the suction chamber contracts under external hydrostatic pressure, hence effecting fuller engagement of the suction pile with the seabed.

Consequently, a suction pile engages with the seabed by virtue of a combination of friction or cohesion and suction. The installation method reflects these factors, firstly by allowing the pile to self-penetrate under its own weight into the seabed and secondly, after a short period of settlement, by pumping water out of the resulting suction chamber to apply suction.

Self-penetration of the pile ends when resistance to relative sliding movement between the skirt and the seabed soil balances the weight of the pile. Suction overcomes that resistance to force the skirt deeper into the seabed, hence enabling the pile to resist forces that will be applied after installation by equipment subsequently anchored to or supported on the pile.

Once embedded into the seabed soil, a suction pile can serve as an anchor or as a support for various types of subsea or surface equipment. For example, suction piles may be used for mooring or tethering a floating platform, a surface vessel such as an FPSO (Floating Production Storage and Offloading) or a subsea riser-supporting buoy. Mooring lines and tethers act in tension and so apply upward traction forces to a suction pile in a largely vertical direction. In that case, it is necessary for the pile to resist being pulled up out of engagement with the seabed.

Suction piles are also commonly used to support the weight of a subsea structure such as a manifold. In that case, the pile must resist largely vertical downward compression forces that tend to bury the pile deeper into the seabed. It is also known to use suction piles to anchor a subsea pipeline. In that case, the pile must resist transverse traction forces that tend to pull the pile horizontally across the seabed.

The top plate serves as a convenient interface with the equipment that the suction pile is intended to anchor or to support. For example, the top plate may provide an attachment point for a mooring line or a tether or for a subsea structure whose weight is to be supported by the suction pile. However, it is also common for a mooring line to be attached to the skirt of a suction pile.

WO 2015/043856 describes a suction pile that may be made of a composite material. Such a pile may be lighter than an equivalent steel pile but therefore suffers from the drawback that more suction has to be applied or additional weight is required to drive the pile into the seabed.

In deep water, suction is generally applied by using a remotely-operated vehicle or ROV (Remotely Operated Vehicle) to pump water from the suction chamber. Such a technique is disclosed in U.S. Pat. No. 5,992,060, albeit applied to a suction follower rather than a suction pile. A suction follower is similar to a suction pile but is designed to be removed from the seabed after burying and installing a plate anchor rather than being left embedded in the seabed to serve as an anchor itself.

Using an ROV to pump water from the suction chamber requires the presence of a surface support vessel for an extended period, noting that pumping may need to continue for, typically, eight to twelve hours. This increases the cost of installation and requires a correspondingly long weather window during which the support vessel can remain safely on station above the installation site.

The installation method described above not only takes a long time but is also risky because of uncertainties caused by the nature and consistency of the seabed soil under the pile. This presents a risk of being unable to embed the pile effectively into the seabed, for example because of greater-than-expected resistance to relative movement between the skirt and the seabed soil.

It may seem self-evident that a low-resistance coating or finish on the skirt of a suction pile could address these problems by allowing the skirt to slide past the surrounding seabed soil more easily. In theory, this would help self-weight and suction to overcome resistance to movement of the skirt through the soil and so would enable the skirt to become embedded to a desired depth more quickly and more reliably.

In practice, however, it is not acceptable to reduce resistance to movement of the skirt through seabed soil in a system that relies substantially upon such resistance to work. It is for this reason that technicians in the art know that the skirt of a suction pile must not be painted. This is because although a suction pile will sink relatively quickly and easily into seabed soil if it has a low-resistance coating such as paint on its skirt, such a pile will have correspondingly reduced resistance to upwards traction. Consequently, only markings such as lines indicating the depth of embedment are painted on the skirt; at least a lower major portion of the skirt is left with a bare steel surface to increase resistance to relative movement between the skirt and the surrounding seabed soil in use.

Corrosion of the bare steel skirt is mitigated by two factors. Firstly there is little water circulation and hence a slow rate of oxygen renewal where the skirt is buried under the seabed. Secondly, a package of sacrificial anodes is attached to the top of the pile to be replaced periodically when necessary.

Of course, leaving a steel surface bare is unusual in the art of marine engineering, where the norm is to paint or otherwise coat a steel surface to protect it from corrosion due to exposure to seawater. Indeed, the mindset in the art is that if the surface of a subsea structure is to be coated with paint or another coating, that coating should remain effective for the design life of the structure. Given the scale of investment and the difficulty of installation and maintenance, especially in deep water, the design life of a subsea structure may be many years.

DE 19533014A describes a sheet pile construction method comprising coating an outer jacket of a pile element with a bentonite suspension to reduce friction. JP 2003328359A describes an adhesion prevention method for a temporarily buried object comprising coating the object in an adhesion preventative material. SU 949067 relates to an anti-friction plastic coating for a foundation pile.

Against this background, the invention involves the use of a low-resistance coating such as an aerogel, an aero-clay or a polymeric film on a bearing surface of a subsea foundation such as a suction pile. When the foundation is installed, the bearing surface is embedded in the seabed soil using the low-resistance coating to reduce resistance to movement of the bearing surface relative to the seabed soil.

The low-resistance coating may then dissolve or fragment away from the bearing surface or transform into a higher-resistance state while remaining on the bearing surface. These mechanisms degrade a resistance-reducing property of the coating to increase resistance to movement of the embedded bearing surface relative to the seabed soil. Suction may be applied to the foundation before or after the resistance-reducing property of the coating has substantially degraded.

Thus, in one sense, the invention resides in a subsea foundation arranged for installation in seabed soil. The foundation has: a bearing surface arranged to be embedded into the seabed soil on installation; and a low-resistance coating that at least partially covers the bearing surface, which coating has a resistance-reducing property to reduce resistance to movement of the bearing surface relative to the seabed soil. In accordance with the invention, the low-resistance coating is composed or arranged to promote degradation of its resistance-reducing property during or after installation.

The resistance-reducing property of the coating may be self-degradable. Degradation of that property may be initiated, caused or promoted by at least one of the following factors: contact with seawater; contact with seabed soil; or an increase in hydrostatic pressure.

Preferably, the low-resistance coating is composed or arranged to delay degradation of its resistance-reducing property before degradation of that property is promoted. For example, the low-resistance coating may have a hydrophobic property, which may be conferred by a hydrophobic coating or a hydrophobic outer layer of the low-resistance coating.

The low-resistance coating is advantageously biodegradable and may be an aerogel, for example a bentonite-based aerogel. The low-resistance coating may instead be an aero-clay or a polymeric film.

The bearing surface may be on a tubular skirt of the foundation, in which case only a radially outer side of the skirt may be coated with the low-resistance coating. More generally, the low-resistance coating may cover between 25% and 75% of at least one side of the skirt.

The low-resistance coating may be composed or arranged to promote degradation of its resistance-reducing property by dissolving or fragmenting away from the bearing surface. In some embodiments of the invention, the low-resistance coating may smooth a bearing surface that is shaped or textured to engage the seabed soil.

In another approach, the low-resistance coating may be composed or arranged to promote degradation of its resistance-reducing property by transforming into a higher-resistance state that increases resistance to movement of the bearing surface relative to the seabed soil.

Preferably, the low-resistance coating is composed or arranged such that its resistance-reducing property is substantially disabled within one month after first immersion of the foundation in seawater.

Correspondingly, in another sense, the invention resides in a method of installing a subsea foundation in seabed soil, the method comprising: lowering the foundation with a low-resistance coating at least partially covering a bearing surface of the foundation; embedding the bearing surface of the foundation in the seabed soil using a resistance-reducing property of the low-resistance coating to reduce resistance to movement of the bearing surface relative to the seabed soil; and increasing resistance to movement of the embedded bearing surface relative to the seabed soil by promoting degradation of the resistance-reducing property of the low-resistance coating.

The bearing surface is suitably embedded in the seabed soil by self-weight of the foundation. The bearing surface may also, or alternatively, be embedded in the seabed soil by applying suction to a suction chamber within the foundation. Suction may be applied before or after substantial degradation of the resistance-reducing property of the low-resistance coating.

Degradation of the resistance-reducing property of the low-resistance coating may be initiated, caused or promoted by at least one of the following events: contact of the coating with seawater; contact of the coating with seabed soil; or an increase in hydrostatic pressure applied to the coating. However, degradation of the resistance-reducing property may initially be delayed after the foundation is immersed in seawater.

The resistance-reducing property may degrade by dissolving or fragmenting the low-resistance coating away from the bearing surface, for example to expose a bearing surface that is shaped or textured to engage the seabed soil. Alternatively, the resistance-reducing property may degrade by transforming the low-resistance coating into a higher-resistance state that increases resistance to movement of the bearing surface relative to the seabed soil.

In summary, in preferred embodiments, the invention provides a foundation to be embedded in the seabed installed by suction, wherein a bearing surface of the foundation is at least partially coated with a degradable coating with low resistance to movement relative to seabed soil. The low-resistance coating may have the effect of substantially reducing friction and/or cohesion between the bearing surface and the surrounding seabed soil, relative to the coating being absent or removed from the bearing surface or being transformed underwater into a higher-resistance state.

The low-resistance property of the coating may preferably be degraded, disabled or deactivated in less than one month from immersion into seawater. Degradation may be self-degradation or may be initiated, caused or promoted by an external factor such as dissolution in seawater, presence of seabed soil or an increase in hydrostatic pressure.

The material of the low-resistance coating may have a hydrophobic property. A hydrophobic coating or a hydrophobic outer layer of the coating is preferred so that the coating will stay in place at least while lowering the pile through seawater from the surface.

A quickly biodegradable coating is preferred. Generally, biodegradable coatings are degradable in air. The behaviour of such coatings in water or in contact with seabed soil (which is typically slightly acidic, corrosive or 'sour') is different. The low-resistance material may be an aerogel, such as a bentonite-based aerogel, or an aero-clay. It is also possible for the low-resistance material to be a polymeric film.

The bearing surface is suitably on a cylindrical skirt of a suction pile. Either or both sides of the skirt may be coated with the low-resistance coating. For example, only the outer side of the skirt may be coated with the low-resistance coating.

The coating may cover between 25% and 75% of the overall outer surface of the skirt. Thus, the whole skirt does not have to be coated: the extent and composition of the coating is suitably calculated to achieve a degree of cohesion, a coefficient of friction or an aggregate resistance to movement that allows embedding of the pile to stop before full embedment: a suction chamber must remain above the seabed soil.

In preferred embodiments, the invention also provides a method to install a suction pile foundation in the seabed. The method comprises: lowering the pile through an expanse of water to the seabed, a bearing surface of the pile being coated with a degradable coating with low resistance to movement relative to seabed soil; letting the pile embed partially into the seabed under self-weight; further embedding the pile into the seabed by applying suction to a suction chamber defined between seabed soil inside the pile and a top plate and skirt of the pile; and allowing the low-resistance property of the coating to degrade to increase friction or cohesion between the pile and the seabed.

Suction may be applied to the suction chamber of the pile before, during or after the low-resistance property of the coating is allowed to degrade.

The method of the invention may be preceded by a step of coating the bearing surface of the pile with a low-resistance degradable material.

Thus, the principle of the invention is to apply a material or coating to the skirt of a suction pile to reduce its resistance to penetration into the seabed soil during installation. During or after installation, that material or coating will dissolve or otherwise transform in a short period of time so as to increase binding between the skirt and the soil.

The period of time in which the coating degrades or transforms from a lower-resistance state to a substantially higher-resistance state is long enough for the pile to settle during installation, or for the pile to be fully installed, but short enough for the pile to be ready for use soon after installation. Typically it is desirable for such piles to be ready for use within a month, and preferably within two weeks, after installation. However it is also desirable for the coating to remain in a lower-resistance state for a period of between a day and a week from first immersion to facilitate installation.

Thus, the coating preferably degrades or transforms in a non-linear way, initially retaining most of its low-resistance properties for an initial period after immersion to allow installation and then relatively quickly losing most of those low-resistance properties during a subsequent period before which installation of the pile may be expected to have been completed.

Degradation or transformation of the coating may be inhibited, resisted or arrested during the initial period and allowed, triggered, accelerated or promoted during the subsequent period. Degradation or transformation of the coating during the subsequent period may be initiated or driven by removal of an inhibiting factor such as a hydrophobic outer layer, by the action of an external or environmental influence such as hydrostatic pressure, or by the application of a triggering factor such as heating.

The invention therefore takes a counter-intuitive approach of easing self-penetration, which significantly reduces the time that must be devoted to suction, while still providing a tension-resistant foundation. A preferably soluble resistance-reducing material is applied to a suction pile to reduce penetration resistance and then dissolves or otherwise disintegrates to increase the in-place capacity of the pile.

The invention saves installation time and increases resistance to movement of a suction pile when in place, which potentially allows the size of the pile to be reduced.

The coating of the invention is to be distinguished from poor-quality coatings or materials that quickly disaggregate. Such coatings or materials have always been considered by those skilled in the art as being failures or of bad quality and so have never been regarded as being technically useful.

Figure 2:
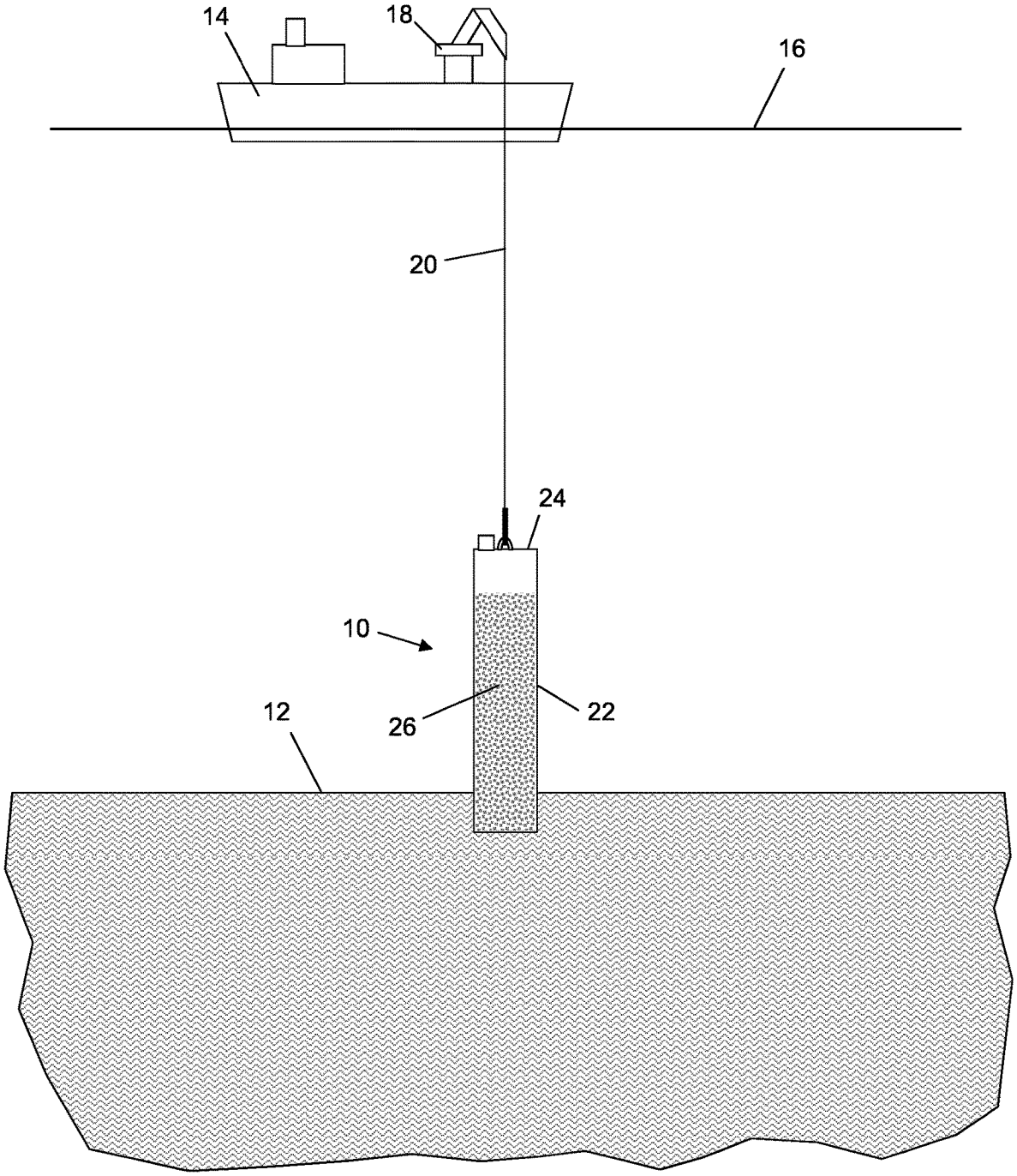
Figure 3:
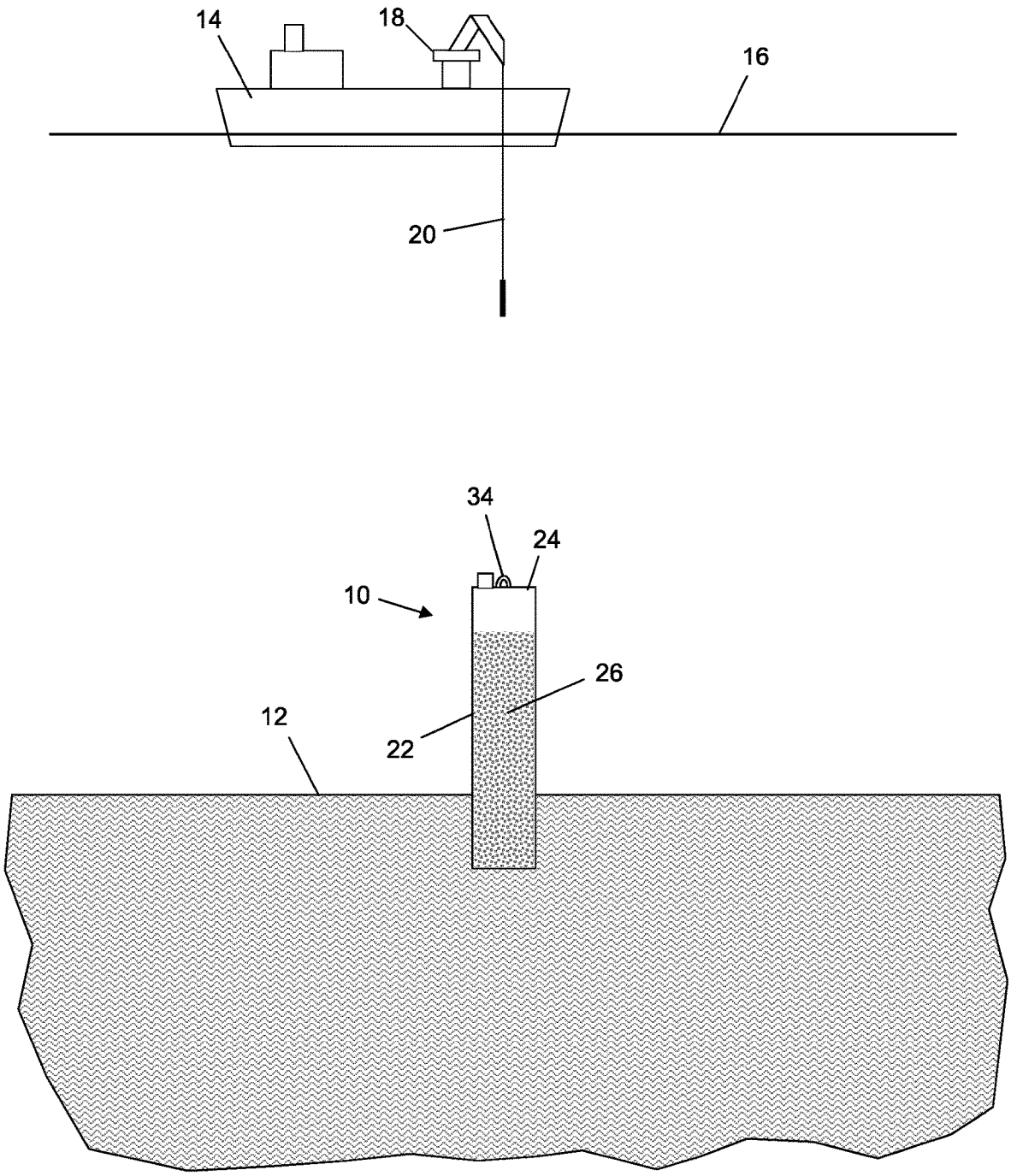
Figure 4:
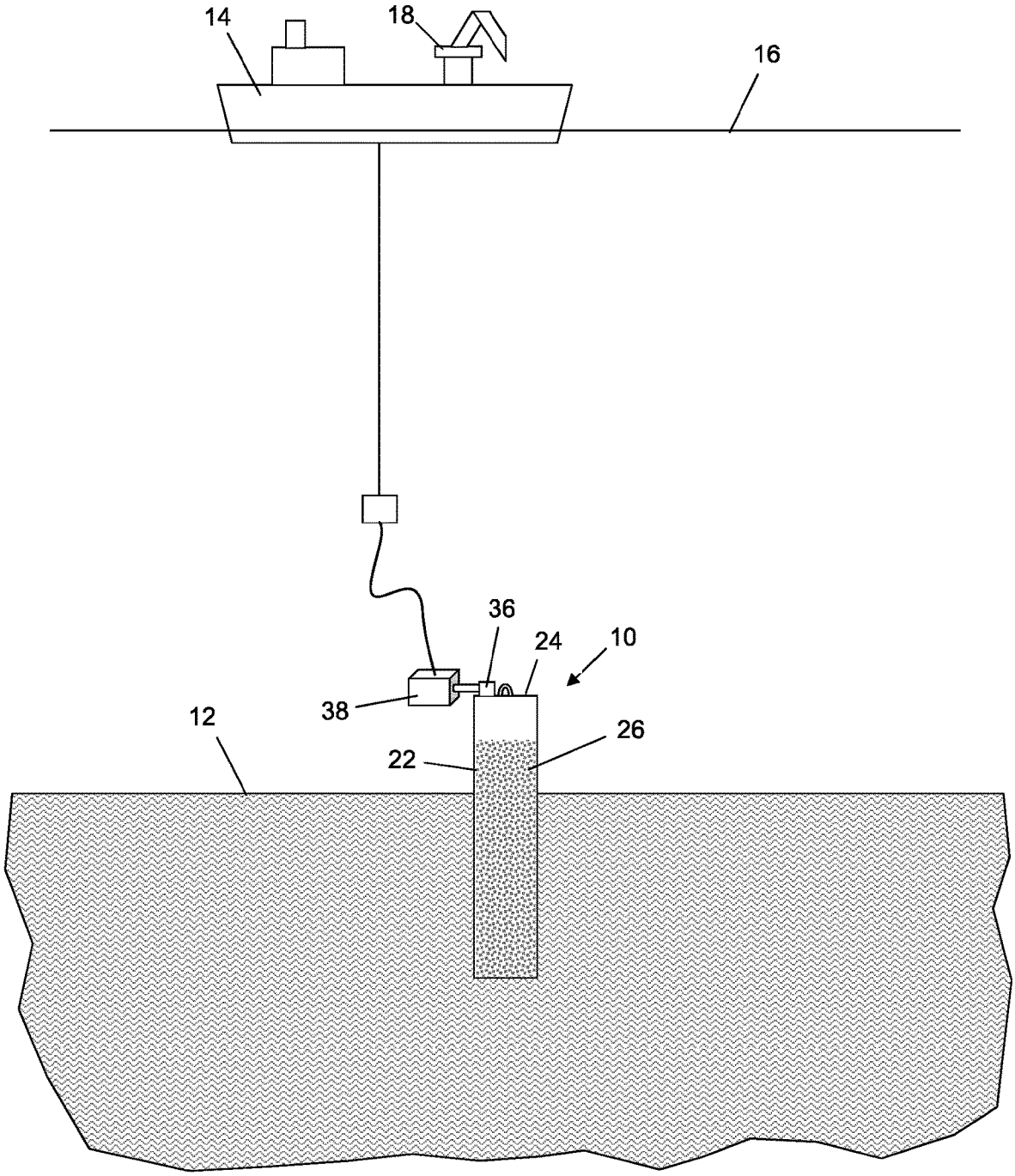
Figure 5:
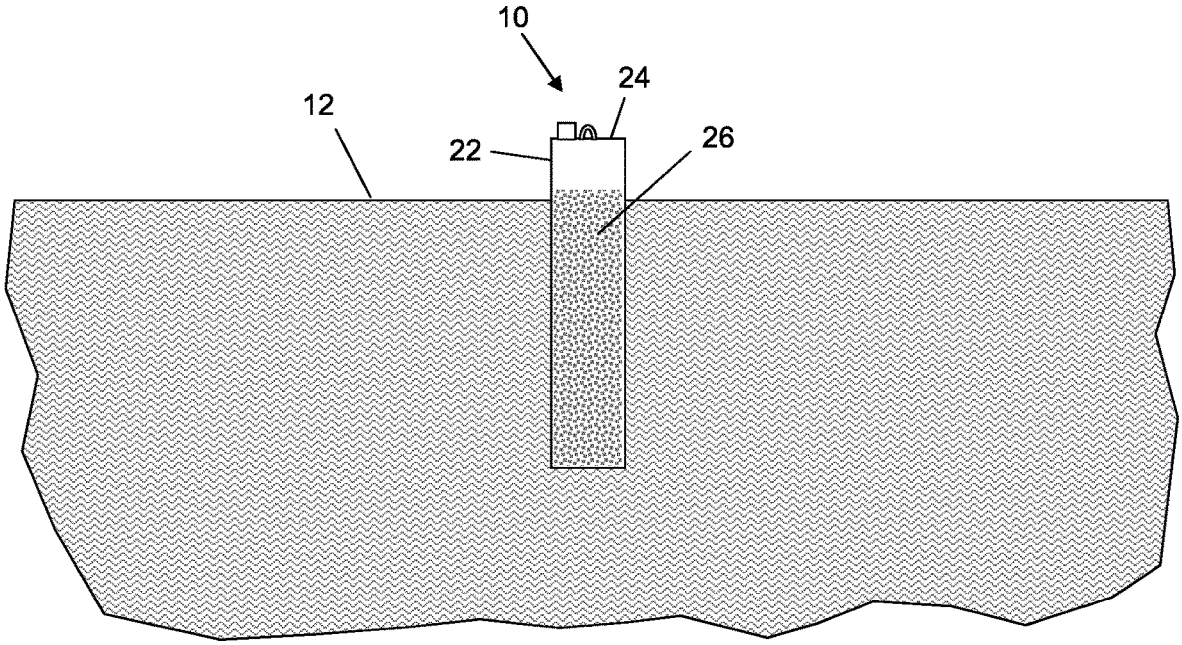
Figure 6:
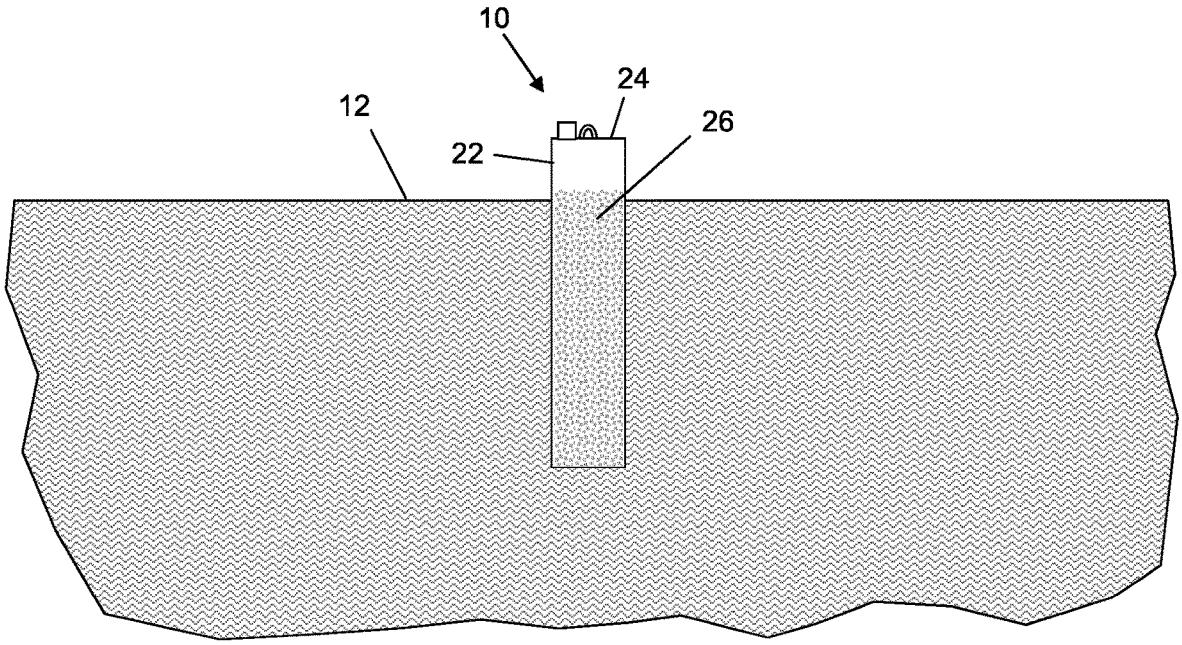
Figure 7:
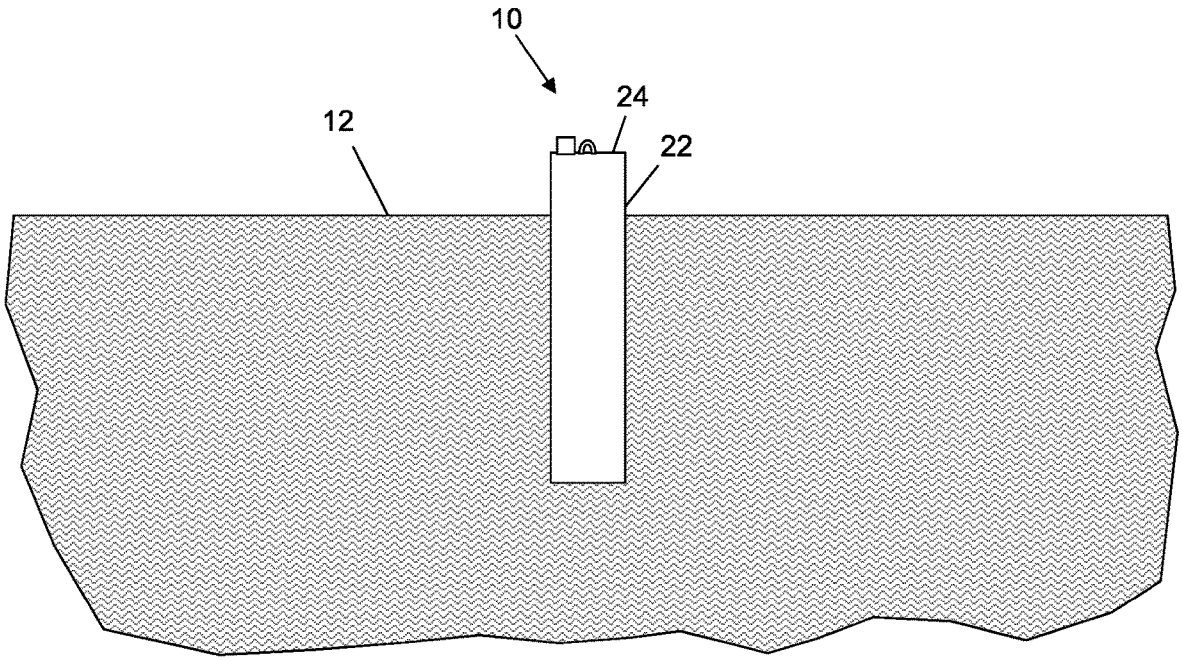
Figure 8:
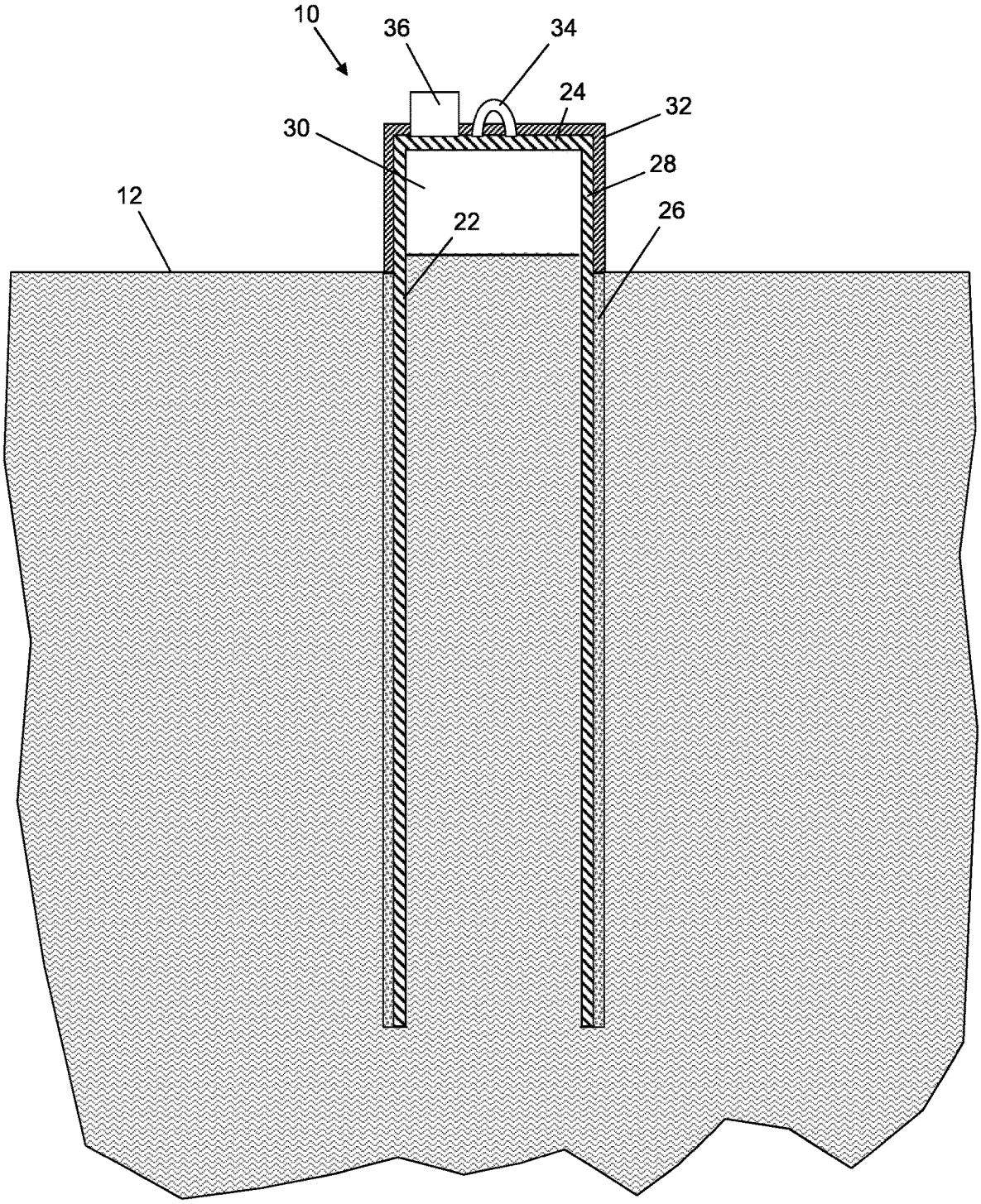
Figure 9:
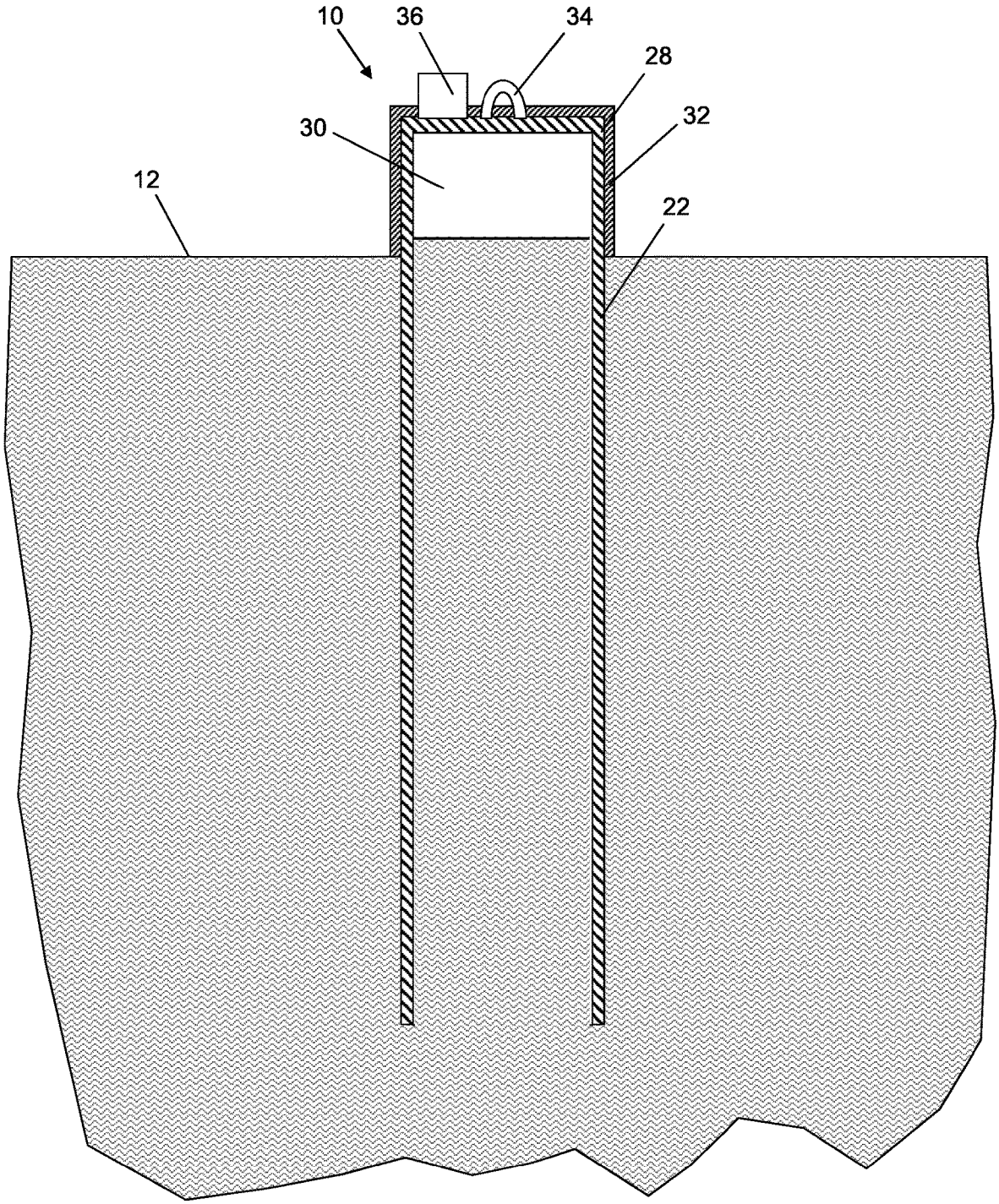
Figure 10:
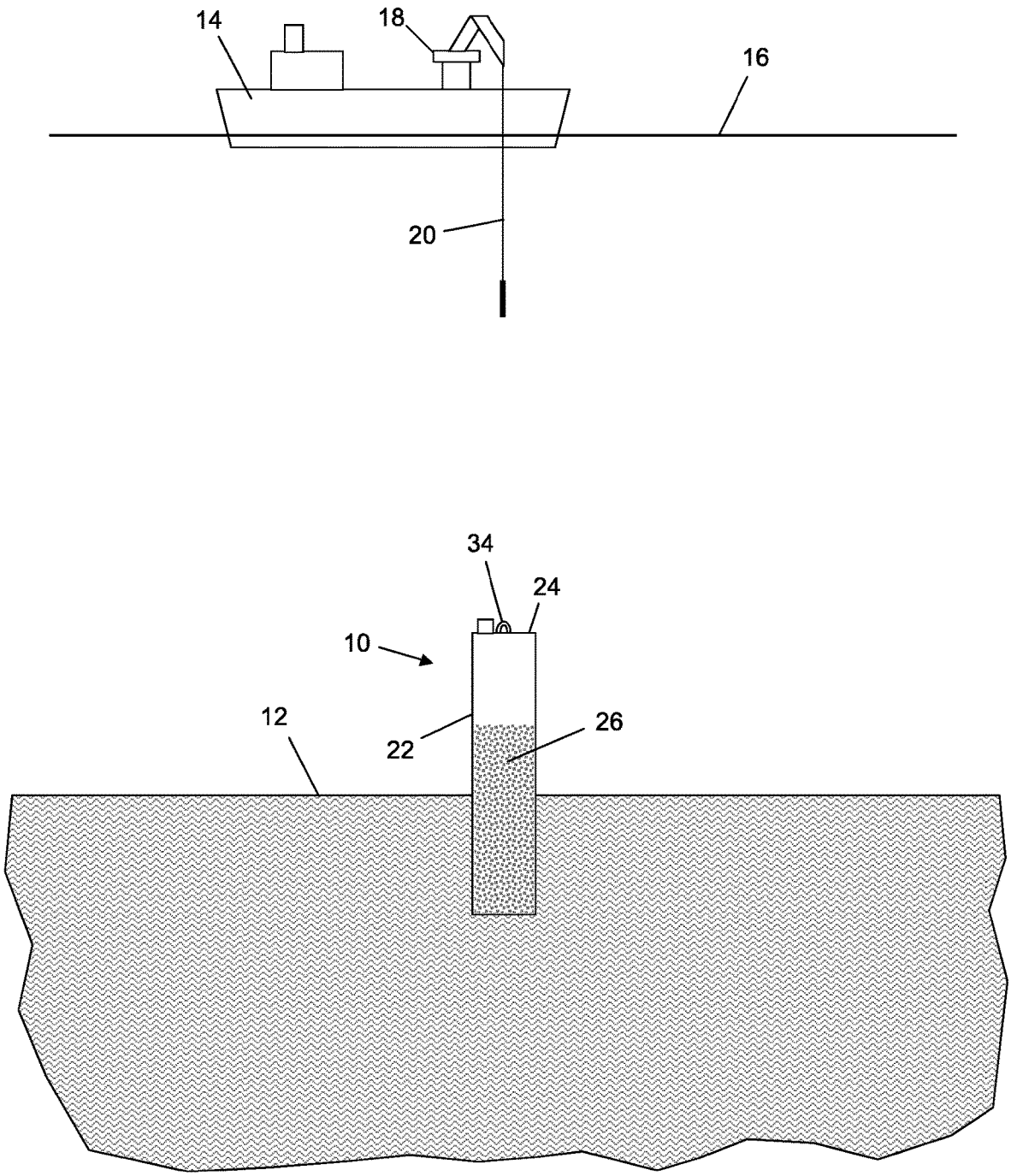
Figure 11:
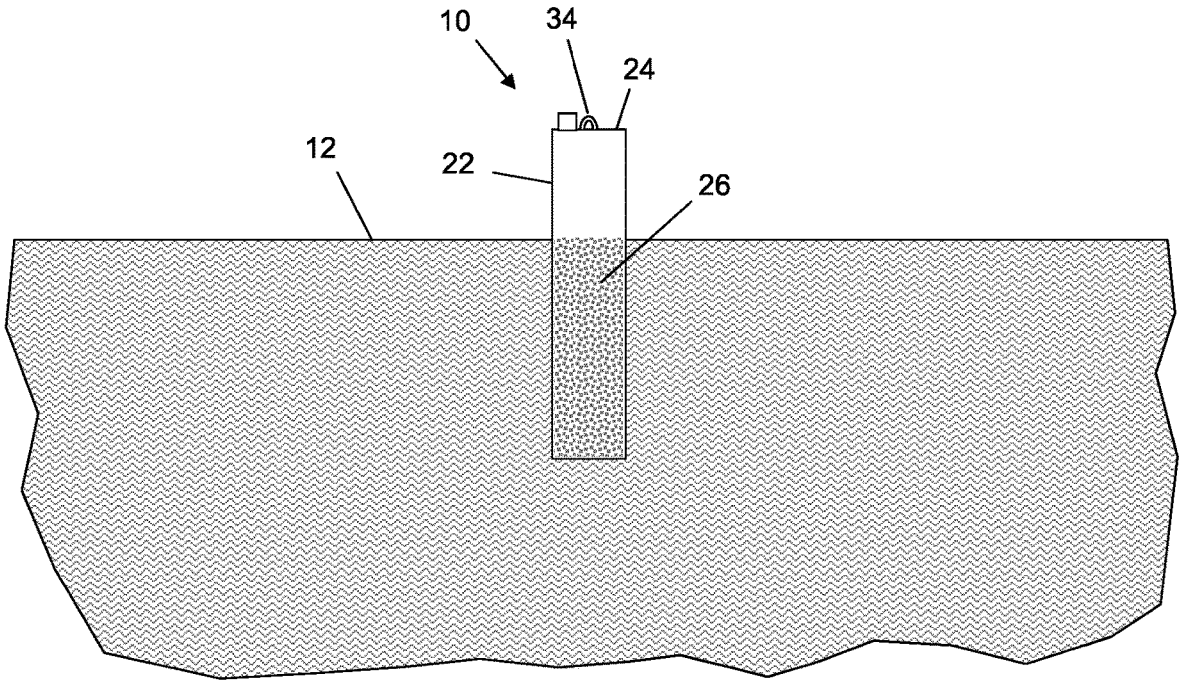
Figure 12:
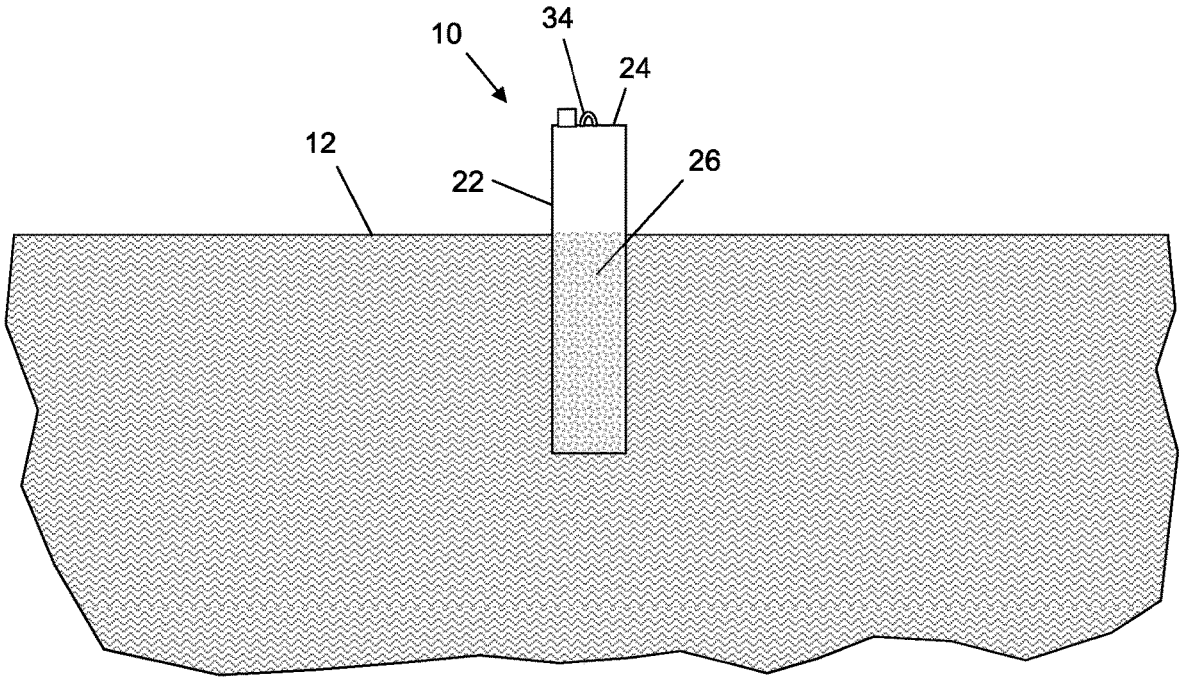
Figure 13:
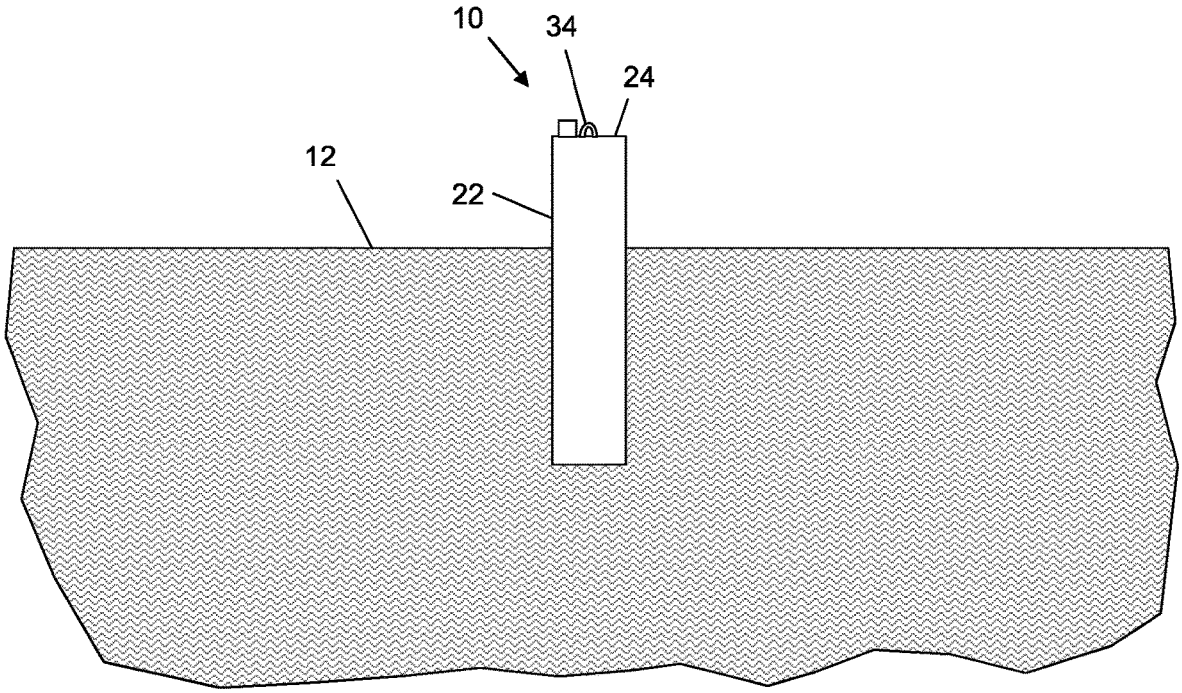
Figure 14:
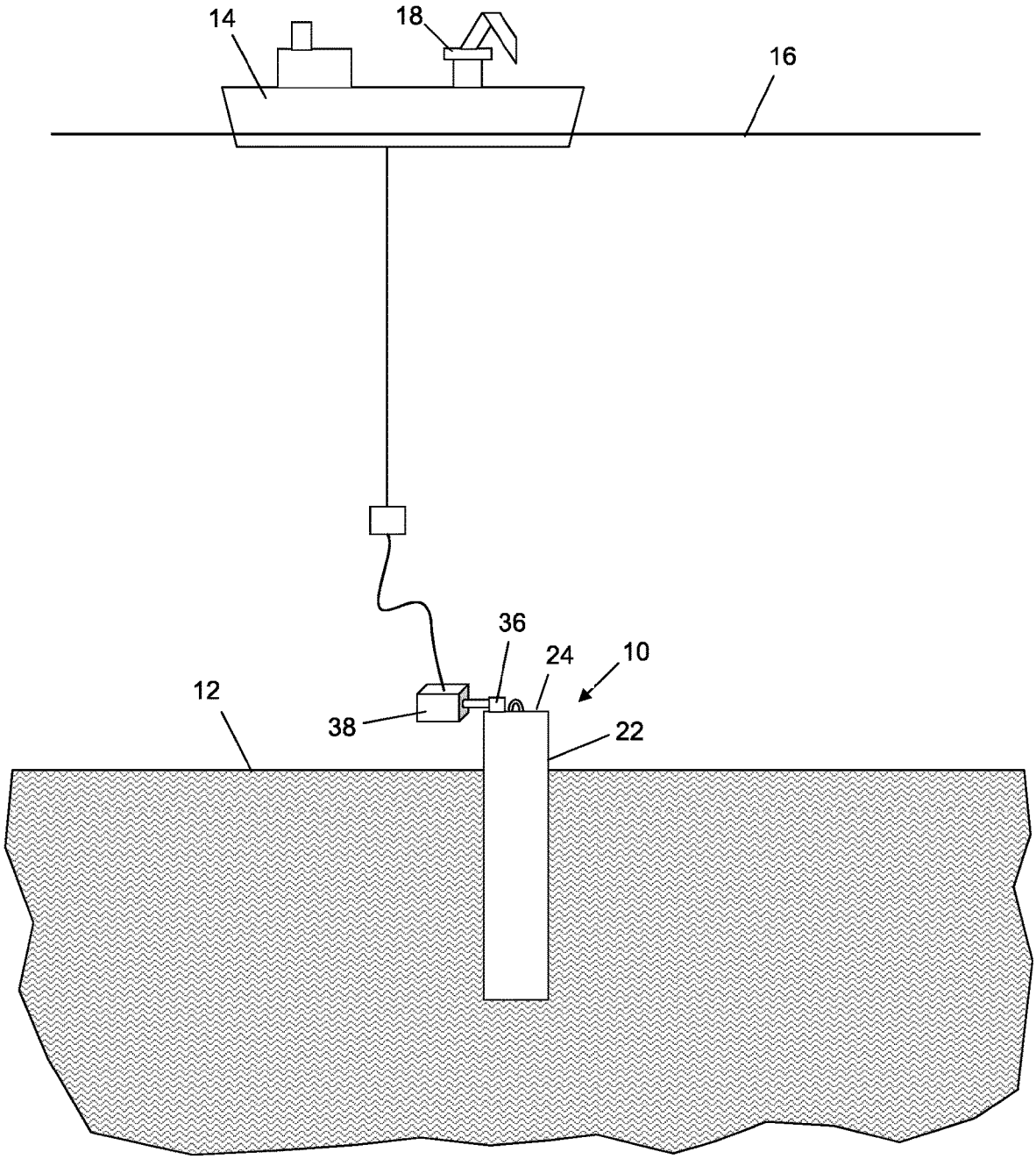
Figure 15:
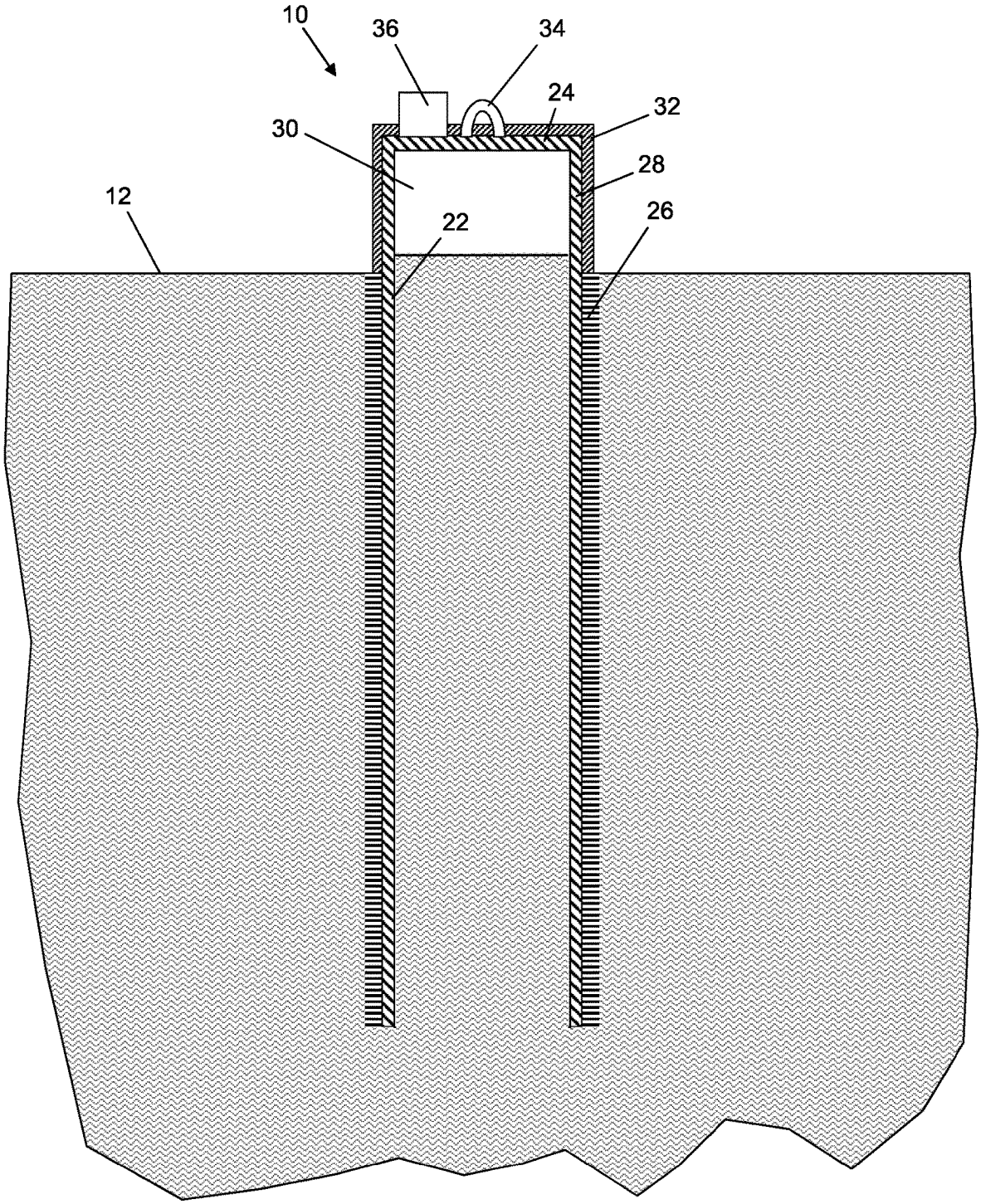
Figure 16A:
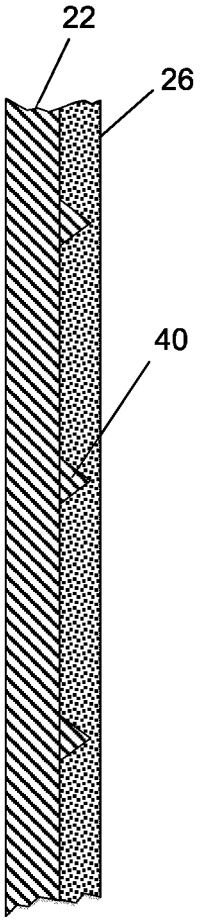
Figure 16B:
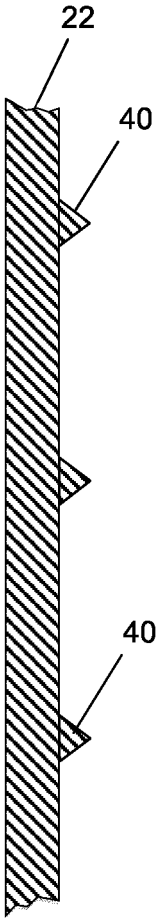
Figure 17:
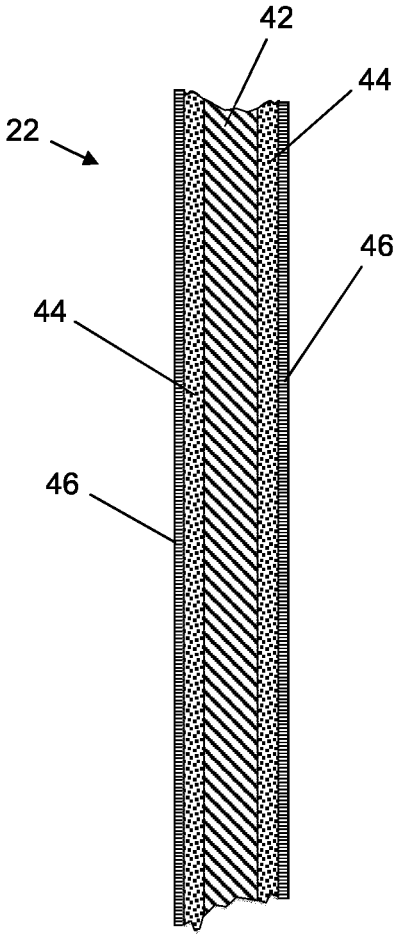

In order that the invention may be more readily understood, reference will now be made, by way of example, to the accompanying drawings in which:

FIG. 1 is a schematic part-sectional side view of an installation vessel lowering a suction pile from the surface toward the seabed, the pile having a rapidly-degradable low-resistance coating in accordance with the invention;

FIG. 2 corresponds to FIG. 1 but shows the suction pile now landed on the seabed and partially embedded in the seabed soil;

FIG. 3 corresponds to FIG. 2 but shows the suction pile now released from the installation vessel to settle deeper into the seabed soil;

FIG. 4 corresponds to FIG. 3 but shows the suction pile now coupled to an ROV to pump water out of its suction chamber to draw the pile deeper into the seabed soil;

FIG. 5 corresponds to FIG. 4 but shows the suction pile now at its intended depth of embedment into the seabed soil;

FIG. 6 corresponds to FIG. 5 but shows the low-resistance coating on the suction pile in the process of degradation;

FIG. 7 corresponds to FIG. 6 but shows the low-resistance coating now substantially fully degraded to an extent that sufficiently negates its resistance-reducing properties;

FIG. 8 is an enlarged sectional view of the suction pile fully embedded in the seabed soil and with its low-resistance coating still intact;

FIG. 9 corresponds to FIG. 8 but shows the low-resistance coating fully degraded;

FIG. 10 shows an alternative method of the invention in which a suction pile has been landed on the seabed and partially embedded in the seabed soil;

FIG. 11 corresponds to FIG. 10 but shows the suction pile now settled deeper into the seabed soil, aided by a low-resistance coating on the suction pile that remains intact;

FIG. 12 corresponds to FIG. 11 but shows the low-resistance coating on the suction pile in the process of degradation;

FIG. 13 corresponds to FIG. 12 but shows the low-resistance coating now substantially fully degraded to an extent that sufficiently negates its resistance-reducing properties;

FIG. 14 corresponds to FIG. 13 but shows the suction pile now coupled to an ROV to pump water out of its suction chamber to draw the pile deeper into the seabed soil;

FIG. 15 is an enlarged sectional view of a suction pile in a variant of the invention, fully embedded in the seabed soil and with a previously low-resistance coating transformed into a high-resistance state;

FIGS. 16*a* and 16*b* are schematic sectional views through a skirt wall of a suction pile in another variant of the invention, the wall in this instance having grip formations shown buried by a low-resistance coating in FIG. 16*a* and exposed by dissolution of the coating in FIG. 16*b*; and FIG. 17 is a schematic sectional view through a skirt wall of a suction pile in another variant of the invention, the wall in this instance having a layered low-resistance coating on both sides.

Reference is made firstly to FIGS. 1 to 7, which together form a sequence of drawings showing the installation of a suction pile 10 of the invention into the seabed 12. This installation method is apt to be used where the seabed is sandy and the engagement mechanism between the pile 10 and the soil of the seabed 12 predominantly involves friction.

FIG. 1 shows an installation vessel 14 on the surface 16 using a crane 18 to lower the pile 10 through the water column toward the seabed 12. At this stage, the pile 10 is suspended from the crane 18 by a wire 20. The pile 10 is elongate and remains upright, indeed substantially vertical, throughout the installation process.

These schematic drawings are not to scale: the suction pile 10 is enlarged relative to the installation vessel 14 for clarity and the water depth between the surface 16 and the seabed 12 will typically be much greater than is shown here.

The pile 10 is of conventional structure, thus being conveniently fabricated from steel. A deep cylindrical skirt 22 defines an open-bottomed hollow straight tube. The top of the skirt 22 is closed by a top plate 24.

Unconventionally, in accordance with the invention, the skirt 22 is coated with a rapidly-degradable low-resistance film or coating 26 applied to the otherwise bare steel of the skirt 22. In this example, the coating 26 is a low-friction coating 26 that extends continuously around a major lower portion of the skirt 22, leaving a minor upper portion 28 of the skirt 22 without the coating 26. In addition to reducing friction, the low-friction coating 26 may also reduce cohesion between the skirt 22 and the soil of the seabed 12.

The upper portion 28 of the skirt 22 is intended to remain protruding above the seabed 12 after the pile 10 has been installed. As shown in FIGS. 8 and 9, this maintains a suction chamber 30 defined between the top plate 24, the embedded skirt 22 and the soil of the seabed 12 encircled by the skirt 22. In principle, the upper portion 28 could be left uncoated but it is preferably painted or otherwise coated with a longer-lasting coating 32 such as an epoxy paint system, as also shown in FIGS. 8 and 9.

The top plate 24 has an attachment point 34 for temporary attachment of the wire 20. Conveniently, the attachment point 34 may also serve as a interface with the equipment that the pile 10 is intended to anchor or to support, for example to attach a mooring line or a tether to the pile 10 after installation.

The top plate 24 also supports a valve 36 to which an ROV 38 may be coupled as shown in FIG. 4. This enables the ROV 38 to pump water out of the suction chamber 30 shown in FIGS. 8 and 9.

FIG. 2 shows the pile 10 now landed on the seabed 12 in an upright orientation. The skirt 22 has become partially embedded into the soil of the seabed 12 under the self-weight and momentum of the pile 10. The soil of the seabed 12 encircled by the embedded skirt 22 closes the bottom of the pile 10 to create the suction chamber 30 shown in FIGS. 8 and 9.

At this stage, the low-friction coating 26 remains intact and retains its friction-reducing properties. This reduces friction between the skirt 22 and the surrounding soil of the seabed 12 to help the pile 10 to penetrate deeper into the seabed 12 on landing, to the benefit of initial stability.

FIG. 3 shows the pile 10 now released from the installation vessel 14 by disconnecting the wire 20 from the attachment point 34 on the top plate 24. Subsea disconnection of the wire 20 may be performed with a remotely-controllable coupling or by using an ROV 38 like that shown in FIG. 4. This allows the pile 10 to settle deeper into the soil of the seabed 12 over time by virtue of self-weight as shown.

Again, at this stage, the low-friction coating 26 remains intact and retains its friction-reducing properties. This reduces friction between the skirt 22 and the surrounding soil of the seabed 12 to help the pile 10 to penetrate deeper into the seabed 12 during a brief period of settlement after landing. This further benefits stability and accelerates the installation process. Eventually, however, self-penetration of the pile 10 will end when the resulting increase in aggregate friction between the skirt 22 and the soil of the seabed 12 balances the weight of the pile 10.

Next, FIG. 4 shows an ROV 38 coupled to the valve 36 to pump water from the suction chamber 30 of the pile 10 that is visible in FIGS. 8 and 9. The resulting underpressure in the suction chamber 30 relative to the higher external hydrostatic pressure draws the top plate 24 toward the seabed 12 as the suction chamber 30 contracts. This overcomes friction to force the skirt 22 deeper into the soil of the seabed 12. Again, at this stage, the low-friction coating 26 remains intact and retains its friction-reducing properties. This reduces friction between the skirt 22 and the surrounding soil of the seabed 12 to help the pile 10 to penetrate quickly and reliably into the seabed 12 as the ROV 38 pumps water out of the suction chamber 30.

Eventually, the pile 10 reaches its intended depth of embedment into the soil of the seabed 12 as shown in FIG. 5. Conveniently, this depth substantially coincides with the longitudinal extent of the low-friction coating 26 on the skirt 22. The ROV 38 is then uncoupled from the valve 36, which maintains an underpressure in the suction chamber 30 to augment frictional engagement between the skirt 22 and the soil of the seabed 12.

Initially, as shown in FIG. 5 and the counterpart detail view in FIG. 8, the low-friction coating 26 remains intact and retains its friction-reducing properties. However, over a short period of say two weeks, the friction-reducing properties of the coating 26 reduce or degrade substantially, for example due to disintegration of the coating 26 itself by dissolution or another disintegrating mechanism. This process of degradation is underway in FIG. 6 and is substantially complete in FIG. 7.

In FIG. 7 and the counterpart detail view in FIG. 9, the coating 26 is no longer present or at least is no longer capable of substantially reducing friction between the skirt 22 and the soil of the seabed 12. For example, the coating 26 may dissolve or fall away to leave the bare steel of the skirt 22 in contact with the soil of the seabed 12, which increases friction between the skirt 22 and the soil. This increased friction resists relative movement between the pile 10 and the seabed 12. The pile 10 is now ready to serve as an anchor or as a support for equipment used in the subsea oil and gas industry, such as an FPSO or a manifold.

Moving on now to FIGS. 10 to 14, this sequence of drawings shows another way of installing a suction pile 10 in accordance with the invention. This installation method is apt to be used where the seabed is of clay and the engagement mechanism between the pile 10 and the soil of the seabed 12 therefore predominantly involves cohesion.

Like numerals are used for like features in FIGS. 10 to 14. In this instance, the low-resistance coating 26 reduces cohesion between the skirt 22 and the soil of the seabed 12. However, the low-resistance coating 26 may also reduce friction between the skirt 22 and the soil of the seabed 12.

FIG. 10 shows the pile 10 having just been landed on the seabed 12 in an upright orientation. The skirt 22 has become partially embedded into the soil of the seabed 12 under the self-weight and momentum of the pile 10. The soil of the seabed 12 encircled by the embedded skirt 22 closes the bottom of the pile 10 to create a suction chamber 30 like that shown in FIGS. 8 and 9.

FIG. 11 shows the pile 10 now settled deeper into the soil of the seabed 12 over time by virtue of self-weight as shown. Eventually, this self-penetration of the pile 10 will end when the resulting increase in resistance to movement of the skirt 22 through the soil of the seabed 12 balances the weight of the pile 10.

Up to this point, the low-resistance coating 26 remains substantially intact and retains its cohesion-reducing properties. This reduces resistance to movement of the skirt 22 through the surrounding soil of the seabed 12 to help the pile 10 to penetrate as deeply as possible into the seabed 12 on landing and during settlement. This deep penetration beneficially shortens the subsequent suction phase.

Next, in a short period of say one to two weeks after settlement, the cohesion-reducing properties of the low-resistance coating 26 reduce or degrade substantially, for example due to disintegration of the coating 26 itself by dissolution or another disintegrating mechanism. This process of degradation is underway in FIG. 12 and is substantially complete in FIG. 13.

In FIG. 13, the low-resistance coating 26 is no longer present or at least is no longer capable of substantially reducing cohesion between the skirt 22 and the soil of the seabed 12. Preferably, the coating 26 dissolves or falls away to leave the bare steel of the skirt 22 in contact with the soil of the seabed 12, which promotes cohesion between the skirt 22 and the soil. This increased cohesion resists relative movement between the pile 10 and the seabed 12.

Next, FIG. 14 shows an ROV 38 coupled to the valve 36 to pump water from the suction chamber 30 of the pile 10 like that shown in FIGS. 8 and 9. The resulting underpressure in the suction chamber 30 relative to the higher external hydrostatic pressure draws the top plate 24 toward the seabed 12 as the suction chamber 30 contracts. This overcomes resistance to force the skirt 22 deeper into the soil of the seabed 12.

Eventually, the pile 10 reaches its intended depth of embedment into the soil of the seabed 12. Conveniently, this depth substantially coincides with the longitudinal extent of the low-resistance coating 26 on the skirt 22. The ROV 38 is then uncoupled from the valve 36, which maintains an underpressure in the suction chamber 30 to augment cohesive engagement between the skirt 22 and the soil of the seabed 12. The pile 10 is now ready to serve as an anchor or as a support for subsea equipment.

FIG. 15 shows a variant of the invention in which the low-resistance coating 26 does not dissolve or fall away from the skirt 22 to degrade its resistance-reducing properties. Instead, the coating 26 remains attached to the skirt and transforms from a low-resistance state to a high-resistance state as shown in FIG. 15. For example, the coating 26 could be of a material that expands after immersion to change a smooth low-friction outer surface to a rougher high-friction outer surface.

FIGS. 16*a* and 16*b* show another variant of the invention in which a soluble or otherwise degradable coating 26 is used to cover and smooth a surface of the skirt 22 that is intrinsically rough for high friction or that is shaped to engage the soil of the seabed 12. In this example, the skirt 22 has a series of circumferential ridges or rings 40 that project radially, and the gaps between the rings 40 are initially filled with a soluble coating 26 as shown in FIG. 16*a* to present a smooth low-friction surface that survives until the pile 10 has been buried. Then, when the coating 26 dissolves, the rings 40 are exposed as shown in FIG. 16*b* to project from the skirt 22 and engage the surrounding soil of the seabed 12.

Turning finally to FIG. 17 of the drawings, this shows two further optional variants of the invention that may be adopted independently or in combination.

Firstly, FIG. 17 shows that a steel wall 42 of the skirt 22 may be coated with a low-resistance coating 26 on either or both of the inner and outer sides of the skirt 22. Coating both sides of the skirt 22 with a low-resistance coating 26 may reduce the aggregate forces that resist movement of the pile 10 as the skirt 22 sinks into the soil of the seabed 12.

Secondly, FIG. 17 shows that the low-resistance coating 26 need not be homogenous through its full thickness. For example, the low-resistance coating 26 may be layered as shown. In this example of a layered coating, an inner layer 44 of the low-resistance coating 26 is degradable by exposure to seawater, for example by dissolution or another mechanism of disintegration. Conversely, an outer layer 46 of the low-resistance coating 26 has hydrophobic characteristics to protect the inner layer 44 from seawater, hence to delay degradation of the inner layer 44.

In a synergistic or co-dependent relationship, the outer layer 46 may be mechanically weak, hence relying upon the inner layer 44 for mechanical support. Indeed, the outer layer 46 could be thin enough to be breached by sliding contact with the soil of the seabed 12 during installation. Breaching the outer layer 46 or seepage under the outer layer 46 exposes the inner layer 44 to seawater, which then degrades and so reduces mechanical support to the outer layer 46. Loss of mechanical support from the inner layer 44 causes the outer layer 46 to fail in turn, which accelerates degradation of the inner layer 44 to degrade the resistance-reducing properties of the low-resistance coating 26.

The low-resistance coating 26 is envisaged to comprise a thin plastics film or biodegradable materials that can be applied onto steel, that degrade in water after approximately two weeks, but preferably not before, and that have a low coefficient of friction. U.S. Pat. No. 3,341,357, for example, teaches a polymer-based coating that quickly degrades. Another example of a component of the low-resistance coating 26 is a hydrophobic, biodegradable nano-coating. Such a coating is offered by Nanotech Industries, Inc. under the trade mark GreenCoat and is the subject of U.S. Pat. No. 8,268,391.

The low-resistance coating 26 may comprise a bentonite-based aerogel, for example being based on drilling gels that are modified to be applied to the skirt 22 as a paint and to withstand lowering through seawater. Such gels may, for example, comprise sodium bentonite and may comply with the API (American Petroleum Institute) Standard 13A Section 9 or 10, *Specifications for Drilling Fluid Materials* or be certified under NSF/ANSI Standard 60. Examples of such gels are sold by CETCO Drilling Products of Illinois, USA.

Many other variations are possible within the inventive concept. For example, as in conventional suction piles, the top plate 24 may comprise openable hatches or may be attached to the skirt 22 only after the skirt 22 has been lowered to the seabed 12. Similarly, a mooring line could be attached to the skirt 22 instead of to the top plate 24. Also, a pump may be integrated with the top plate 24 of the pile 10 rather than being implemented in an ROV 38.

To modify the characteristics of the system and hence the behaviour of the pile 10 when being embedded into the seabed 12, the low-resistance coating 26 need not extend continuously around or along the skirt 22. The low-resistance coating 26 could instead be interrupted in a circumferential and/or longitudinal direction by one or more gaps. Thus, for example, the low-resistance coating 26 could be applied to the skirt in one or more longitudinally-extending stripes or circumferentially-extending hoops.

It would be possible for the low-resistance coating 26 to extend onto the upper portion 28 of the pile 10 that remains protruding above the seabed 12 after installation. If the upper portion 28 is itself coated with a longer-lasting coating 32 such as paint, the low-resistance coating 26 could initially overlap onto that coating 32 before the coating 26 degrades.

It is common in the art for a group of two or more suction piles to be used together to form a foundation or anchorage. It is also common in the art for one or more suction piles to be built into an item of equipment such as a template to serve as an integrated foundation. It will therefore be evident to the skilled reader that the principles of the invention may be applied to groups of suction piles or to integrated suction piles.

The invention claimed is:

1. A subsea foundation arranged for installation in seabed soil, the foundation having:

a bearing surface arranged to be embedded into the seabed soil on installation; and a low-resistance coating that at least partially covers the bearing surface, which coating has a resistance-reducing property to reduce resistance to movement of the bearing surface relative to the seabed soil;

wherein the low-resistance coating is an aerogel or an aerogel-clay and is composed or arranged to promote degradation of the resistance-reducing property of the low-resistance coating during or after installation.

2. The foundation of claim 1, wherein the resistance-reducing property is self-degradable.

3. The foundation of claim 1, wherein degradation of the resistance-reducing property may be initiated, caused or promoted by at least one of the following factors:

contact with seawater;

contact with the seabed soil; or an increase in hydrostatic pressure.

4. The foundation of claim 1, wherein the low-resistance coating is composed or arranged to delay degradation of the resistance-reducing property of the low-resistance coating before degradation of the resistance-reducing property is promoted.

5. The foundation of claim 1, wherein the low-resistance coating has a hydrophobic property.

6. The foundation of claim 5, wherein the hydrophobic property is conferred by a hydrophobic coating or a hydrophobic outer layer of the low-resistance coating.

7. The foundation of claim 1, wherein the low-resistance coating is biodegradable.

8. The foundation of claim 1, wherein the aerogel of the low-resistance coating is bentonite-based.

9. The foundation of claim 1, wherein the bearing surface is on a tubular skirt of the foundation.

10. The foundation of claim 9, wherein only a radially outer side of the skirt is coated with the low-resistance coating.

11. The foundation of claim 9, wherein the low-resistance coating covers between 25% and 75% of at least one side of the skirt.

12. The foundation of claim 1, wherein the low-resistance coating is composed of or arranged to promote degradation of the resistance-reducing property of the low-resistance coating by dissolving or fragmenting away from the bearing surface.

13. The foundation of claim 1, wherein the low-resistance coating smoothes a bearing surface that is shaped or textured to engage the seabed soil.

14. The foundation of claim 1, wherein the low-resistance coating is composed or arranged to promote degradation of the resistance-reducing property of the low-resistance coating by transforming into a higher-resistance state that increases resistance to movement of the bearing surface relative to the seabed soil.

15. The foundation of claim 1, wherein the low-resistance coating is composed or arranged such that the resistance-reducing property of the low-resistance coating is substantially disabled within one month after first immersion of the foundation in seawater.

16. A method of installing a subsea foundation in seabed soil, the method comprising:

lowering the foundation with a low-resistance coating comprising an aerogel or an aero-clay at least partially covering a bearing surface of the foundation;

embedding the bearing surface of the foundation in the seabed soil using a resistance-reducing property of the low-resistance coating to reduce resistance to movement of the bearing surface relative to the seabed soil; and increasing resistance to movement of the embedded bearing surface relative to the seabed soil by promoting degradation of the resistance-reducing property of the low-resistance coating.

17. The method of claim 16, comprising embedding the bearing surface in the seabed soil by self-weight of the foundation.

18. The method of claim 16, comprising embedding the bearing surface in the seabed soil by applying suction to a suction chamber within the foundation.

19. The method of claim 18, comprising applying suction after substantial degradation of the resistance-reducing property of the low-resistance coating.

20. The method of claim 16, comprising initiating, causing or promoting degradation of the resistance-reducing property of the low-resistance coating by at least one of the following events:

contact with seawater;

contact with the seabed soil; or an increase in hydrostatic pressure.

21. The method of claim 16, comprising initially delaying degradation of the resistance-reducing property of the low-resistance coating after the foundation is immersed in seawater.

22. The method of claim 16, comprising degrading the resistance-reducing property by dissolving or fragmenting the low-resistance coating away from the bearing surface.

23. The method of claim 22, comprising dissolving or fragmenting the low-resistance coating to expose a bearing surface that is shaped or textured to engage the seabed soil.

24. The method of claim 16, comprising degrading the resistance-reducing property by transforming the low-resistance coating into a higher-resistance state that increases resistance to movement of the bearing surface relative to the seabed soil.

25. The method of claim 16, comprising substantially disabling the resistance-reducing property of the low-resistance coating within one month after first immersion of the foundation in seawater.

* * * * *